US009452635B2

(12) United States Patent
Haydt, III et al.

(10) Patent No.: US 9,452,635 B2
(45) Date of Patent: Sep. 27, 2016

(54) APPARATUS FOR INSERTING DOCUMENTS INTO ENVELOPES AND ASSOCIATED METHOD

(71) Applicant: T.S.D. LLC, Sebastian, FL (US)

(72) Inventors: Leo A. Haydt, III, Sebastian, FL (US); Kevin J. Ranson, Melbourne, FL (US); Michael S. Lukins, Indialantic, FL (US)

(73) Assignee: T.S.D. LLC, Sebastian, FL (US)

( * ) Notice: Subject to any disclaimer, the term of this patent is extended or adjusted under 35 U.S.C. 154(b) by 465 days.

(21) Appl. No.: 14/078,627

(22) Filed: Nov. 13, 2013

(65) Prior Publication Data

US 2015/0128533 A1 May 14, 2015

(51) Int. Cl.

| | |
|---|---|
| ***B43M 3/00*** | (2006.01) |
| ***B43M 3/04*** | (2006.01) |
| ***B43M 5/04*** | (2006.01) |
| ***B43M 7/00*** | (2006.01) |

(52) U.S. Cl.

CPC ..... *B43M 3/045* (2013.01); *B43M 5/042* (2013.01); *B43M 7/004* (2013.01)

(58) Field of Classification Search

CPC ..... B43M 3/00; B43M 3/04; B43M 3/045; B43M 5/04; B43M 5/042

USPC ..... 53/569, 250, 251, 255, 258, 284.3, 53/381.5, 381.6, 381.7; 270/58.06; 198/377.08

See application file for complete search history.

(56) References Cited

U.S. PATENT DOCUMENTS

| | | | | |
|---|---|---|---|---|
| 3,834,691 | A * | 9/1974 | Paulson | B65H 1/06 198/597 |
| 3,996,727 | A * | 12/1976 | Irvine | B43M 3/00 53/381.7 |
| 4,499,705 | A * | 2/1985 | Russell | B43M 3/00 53/284.3 |
| 4,527,378 | A * | 7/1985 | Russell | B43M 3/00 493/245 |

(Continued)

FOREIGN PATENT DOCUMENTS

| | | |
|---|---|---|
| EP | 2347917 | 7/2011 |
| EP | 2617582 | 7/2013 |

(Continued)

OTHER PUBLICATIONS

U.S. Appl. No. 13/972,972, filed Aug. 22, 2013.

*Primary Examiner* — Andrew M Tecco
*Assistant Examiner* — Praachi M Pathak
(74) *Attorney, Agent, or Firm* — Allen, Dyer, Doppelt, Milbrath & Gilchrist, P.A.

(57) ABSTRACT

An apparatus inserts documents into envelopes and includes a document insert station and a document conveyor that conveys documents to be inserted within envelopes to the document insert station. Each envelope has an envelope opening and a flap to close the opening and defines a hinge line. An envelope feeder feeds envelopes upside down on the hinge line with the flap up into the document insert station and angled from the document conveyor. An insert plate is positioned at the document insert station that receives a document conveyed from the document conveyor and includes orifices though which air is blown onto the envelope fed into the document insert station to open the envelope and receive a document conveyed from the document conveyor.

18 Claims, 12 Drawing Sheets

(56) References Cited

U.S. PATENT DOCUMENTS 5,097,654 A * 3/1992 Latsounas ..... B43M 3/00 53/284.3
5,374,152 A * 12/1994 Tovini ..... B43M 7/02 414/403
5,560,185 A * 10/1996 Petkovsek ..... B43M 5/042 53/284.3
5,618,375 A * 4/1997 Suzuki ..... B43M 5/042 156/442.2
5,722,221 A 3/1998 Maltman et al.
5,950,399 A * 9/1999 Viens ..... B43M 5/042 53/284.3
5,954,323 A 9/1999 Emigh et al.
6,038,835 A * 3/2000 de Haan ..... B43M 5/042 53/284.3
6,076,336 A * 6/2000 Cross ..... H04N 1/4466 53/206
6,164,046 A * 12/2000 Werner ..... B43M 3/045 53/284.3
6,289,658 B1 * 9/2001 Sting ..... B43M 3/045 53/252
6,453,651 B1 * 9/2002 Werner ..... B43M 3/045 53/381.5
7,380,715 B2 6/2008 Bennett et al.
7,389,624 B2 * 6/2008 Henry ..... B43M 3/045 53/381.5
8,272,498 B2 9/2012 Ponti
8,453,417 B2 6/2013 Oshio et al.
2003/0150194 A1 * 8/2003 Ponti ..... B43M 3/045 53/569
2005/0072126 A1 * 4/2005 Botschek ..... B43M 3/00 53/569
2005/0217210 A1 * 10/2005 Sting ..... B43M 3/04 53/284.3
2007/0040316 A1 * 2/2007 Kern ..... B43M 3/04 270/58.06
2007/0125045 A1 * 6/2007 Sytema ..... B43M 3/045 53/460
2008/0302068 A1 * 12/2008 Ponti ..... B43M 3/045 53/569
2009/0165426 A1 * 7/2009 Marcinik ..... B43M 3/045 53/396
2011/0204562 A1 * 8/2011 Peterson ..... B43M 3/045 271/253
2014/0196414 A1 * 7/2014 Schempp ..... B43M 3/00 53/492
2015/0158673 A1 * 6/2015 Lenser ..... B65G 15/58 198/617

FOREIGN PATENT DOCUMENTS

GB 1045672 10/1966
WO 03/041017 5/2003

* cited by examiner

APPARATUS FOR INSERTING DOCUMENTS INTO ENVELOPES AND ASSOCIATED METHOD

FIELD OF THE INVENTION

The present invention relates to document insertion machines, and more particularly, this invention relates to an apparatus and method for inserting documents into envelopes.

BACKGROUND OF THE INVENTION

Modern mailing systems include different machines and operations for printing, organizing, collating, and folding mail materials, sheets, or other documents. These operations are followed by processes for inserting the finalized documents into envelopes. The documents are usually prepared for insertion by processing material in folding machines that use a tool or other mechanical pressure to create a sharply defined crease into a sheet of flexible substrate material, such as the paper or paper sets forming the document, using either a knife folding or buckle folding operation.

For example, commonly assigned U.S. patent application Ser. No. 13/972,972 filed on Aug. 22, 2013, the disclosure which is hereby incorporated by reference in its entirety, discloses a folding machine as combined knife and buckle folders to allow high speed folding of more than one sheet of flexible substrate material into a page set. After folding and forming the sheets of material as a document to be inserted within an envelope, the documents are further processed through a document insertion machine that inserts the documents into envelopes. Some document insertion machines perform some collating and similar processes. Different types of document insertion machines may be used, including the early "Phillipsburg-type" machine that includes picking stations having a respective stack of sheets or other mail inserts and a picker arm that grips a sheet to be inserted into an envelope.

In one exemplary document insertion machine, a stream of open envelopes are conveyed by a conveyor past an inserter arm while individual inserts as documents are retrieved from insert hoppers and added to form a final document. The same or another inserter arm inserts or "stuffs" each packet of mail materials forming the document into an open envelope by pushing the document with pusher members or "fingers." Once the document is inserted, an envelope is conveyed to an envelope sealing station where the flap covering the envelope opening is sealed shut. Some document insertion machines hold an envelope open using suction cups or other vacuum draw, while other machines blow air into the envelope to open the envelope. Some document insertion machines use suction cups in combination with a vacuum draw to hold an envelope open and create a pocket for insertion of the document. Applying vacuum or suction cups is a slow technique and sometimes dust or other contaminants may enter the machine and interfere with the vacuum or suction. Often these types of document insertion machines and related processing equipment will jam under high speed operation.

Another technical drawback is typically the envelope is fed with the flap over the envelope opening and oriented downward in a standard letter or envelope configuration. The envelope is then moved horizontally or vertically, making document insertion difficult. Also, many of these systems are limited in speed and efficiency.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

An apparatus inserts documents into envelopes and includes a document insert station and a document conveyor that conveys documents to be inserted within envelopes to the document insert station. Each envelope has an envelope opening and a flap to close the opening and defining a hinge line. An envelope feeder feeds envelopes upside down on the hinge line with the flap up into the document insert station and angled from the document conveyor. An insert plate is positioned at the document insert station and receives a document conveyed from the document conveyor. The insert plate includes orifices though which air is blown into the envelope opening that is exposed since the flap has been moved down in order to open the envelope and receive the document conveyed from the document conveyor.

In one example, the envelope feeder includes a vacuum feed table that is angled to orient each envelope away from the document conveyor as described above. In another example, the insert plate is configured to engage the flap of the envelope and retain the flap open such that documents can be inserted within the envelope opening as the envelope is fed along the vacuum feed table.

In another example, the insert plate includes an air manifold connecting to the air orifices through which air is blown. The document conveyor, in an example, is positioned above the insert plate allowing documents conveyed along the document conveyor to drop onto the insert plate and towards the envelope opening of the envelope fed into the document insert station. The document conveyor includes pusher pins that engage the document and push the document into the envelope opening. Pusher fingers may be mounted at the insert plate and receive the document and insert the document fully into the envelope. In an example, the document conveyor is formed as a belt conveyor having an end positioned adjacent the insert plate, which includes slots that receive the pusher pins as the pusher pins traverse around the end of the belt conveyor adjacent the insert plate.

In another example, an envelope sealer is positioned after the document insert station and seals the flap over the envelope opening. An envelope lay down mechanism is positioned after the envelope sealer and configured to lay down the envelope into a horizontal position. In different examples, the documents can be formed as one or more sheets of paper. In yet another example, the upper edge of each envelope is oriented at an angle of 35 to 45 degrees from the horizontal and away from the document conveyor. In yet another example, this angle is 41 degrees.

A method aspect is also set forth and includes conveying documents to be inserted within envelopes along a document conveyor into a document insert station. Each envelope has an envelope opening and a flap to close the opening and defining a hinge line. The method includes feeding envelopes upside down on the hinge line with the flap up and angled from the document conveyor. The method includes forcing the flap down from the envelope opening, blowing air into the envelope opening to open the envelope and inserting a document conveyed from the document conveyor into the envelope.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Different embodiments will now be described more fully hereinafter with reference to the accompanying drawings, in which preferred embodiments are shown. Many different forms can be set forth and described embodiments should not be construed as limited to the embodiments set forth herein. Rather, these embodiments are provided so that this disclosure will be thorough and complete, and will fully convey the scope to those skilled in the art.

Figure 1:
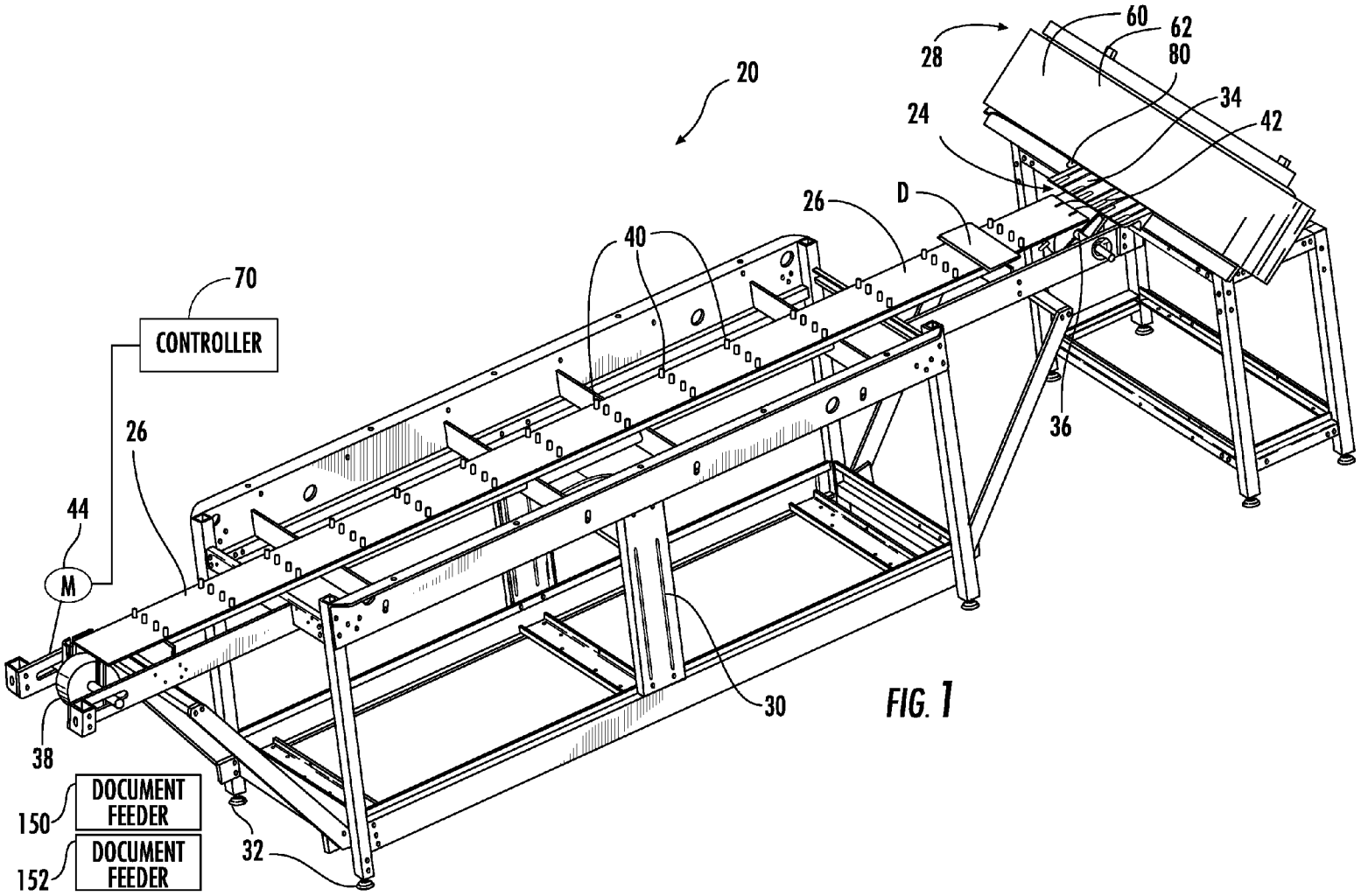
FIG. 1 is an isometric view of the document insertion machine showing a document transported along the document conveyor into the document insert station where it will be inserted into an envelope fed into the document insert station.
Figure 3:
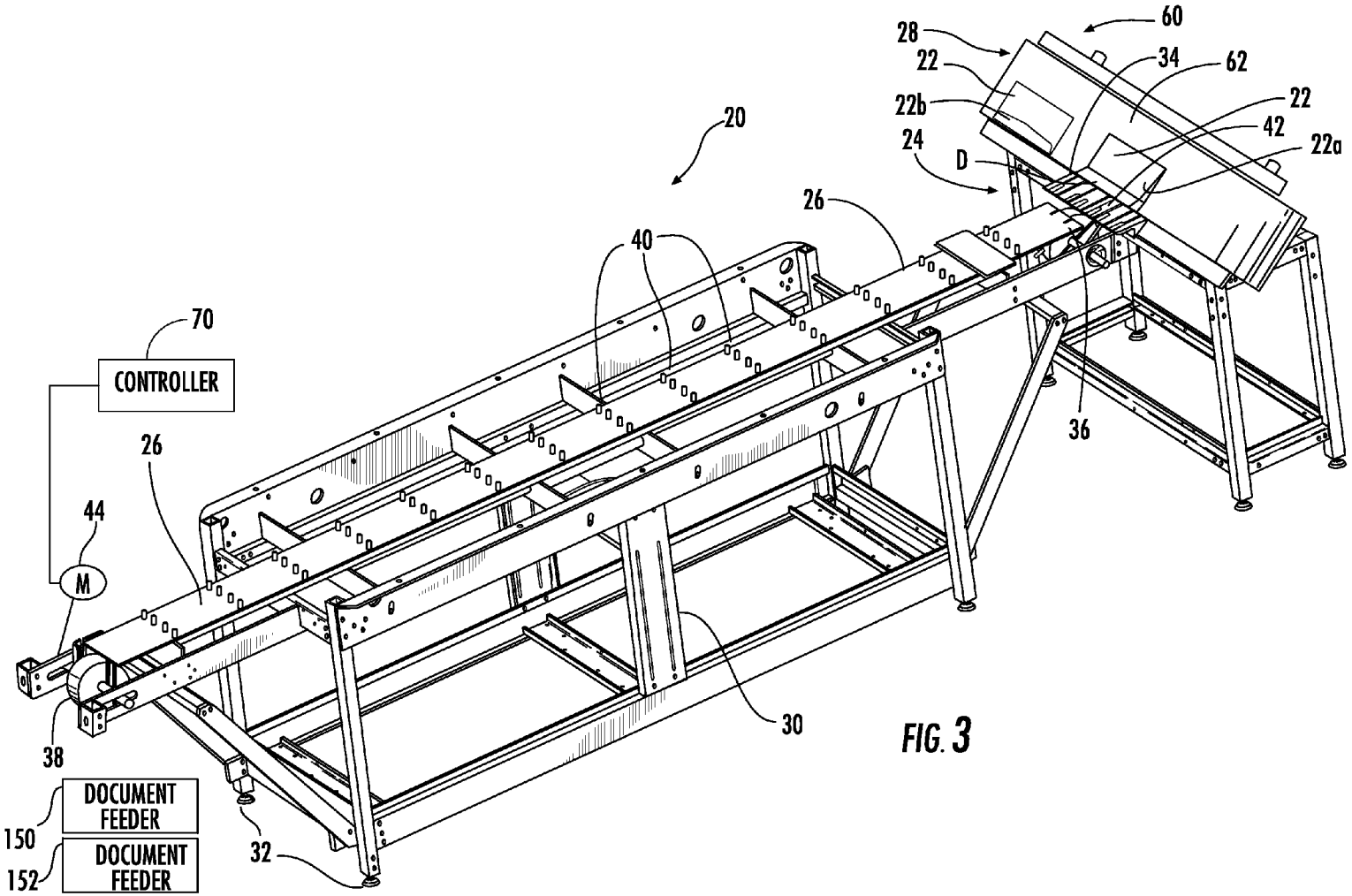
FIG. 3 is another isometric view of the document insertion machine showing a document received over the insert plate and showing the document initially inserted within the envelope opening.
Figure 4:
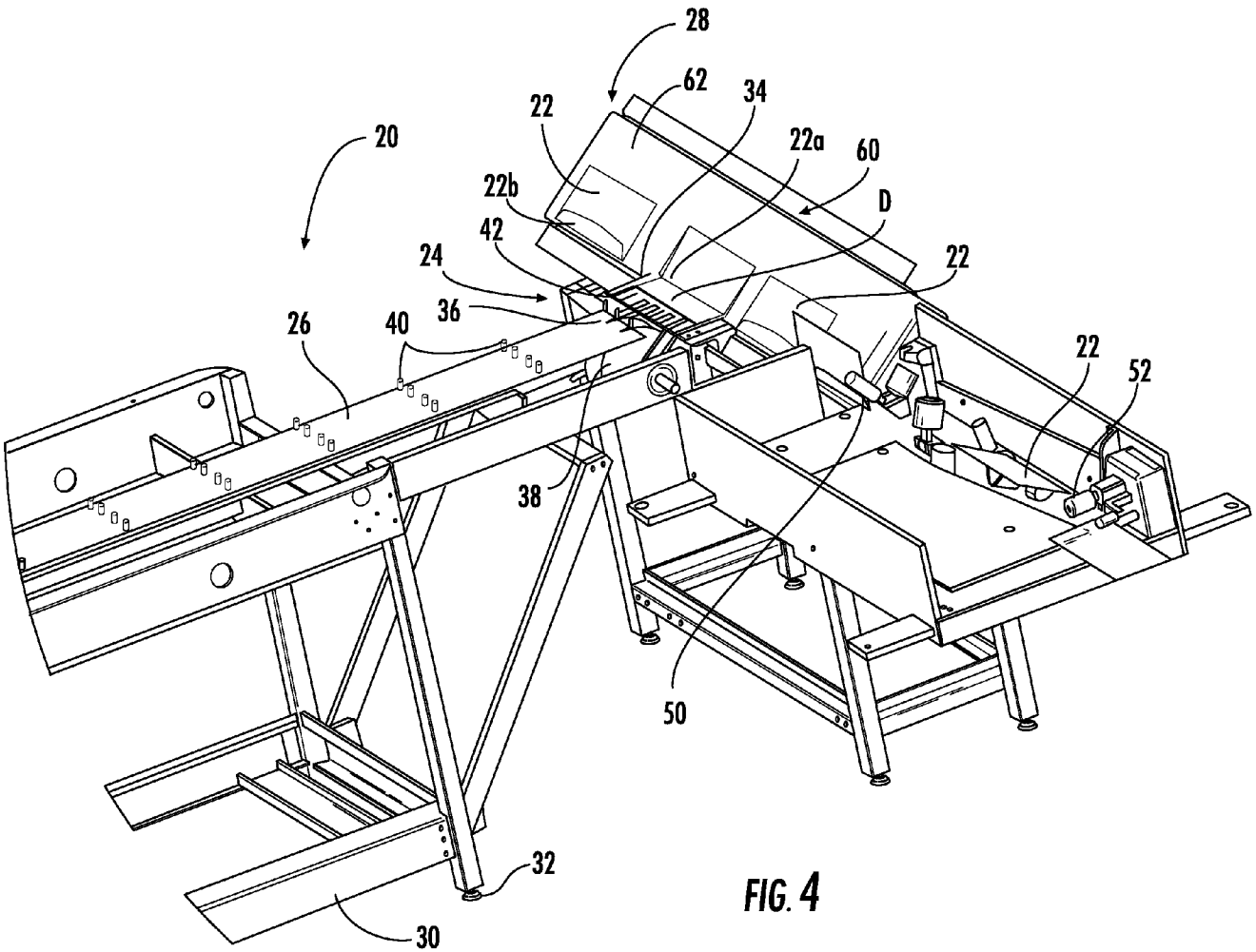
FIG. 4 is another isometric view of the document insertion machine showing the envelope sealer and envelope lay down mechanism used in association with the envelope feeder and document conveyor.

FIG. 1 is an isometric view of the document insertion machine at 20 that inserts documents (D) into envelopes shown generally at 22. The machine 20 includes basic components of a document insert station shown generally at 24 and a document conveyor shown generally at 26 that conveys documents to be inserted within the envelopes 22 fed to the document insert station 24 by an envelope feeder shown generally at 28. Each envelope has an envelope opening 22*a* and a flap 22*b* to close the opening and defining a hinge line 22*c*. The envelope feeder 28 feeds the envelopes upside down along the hinge line 22*c* into the document insert station 22. As shown in FIG. 3, each envelope 22 has its flap 22*b* pointed upward since the envelope is upside down and in a position to close the envelope opening 22*a*. Each envelope 22 is angled from the document conveyor 26 wherein the top of the envelope as illustrated and corresponding to the bottom of the envelope when oriented correctly is pivoted back as shown in FIG. 3.

The document conveyor 26 is supported by a support frame 30 formed from thin steel, aluminum or other rigid, strong material and forms a support structure as illustrated such that the document conveyor 26 is elevated a few feet above the floor of the shop or other work area. Although not illustrated in detail, the frame 30 construction may include castered wheels 32 located at the bottom of the support frame 30 to allow ready movement with little difficulty by even a single operator when the document conveyor 26 is unattached to the document insert station 24, including the insert plate 34 that receives the documents from the document conveyor 26.

Figure 7:
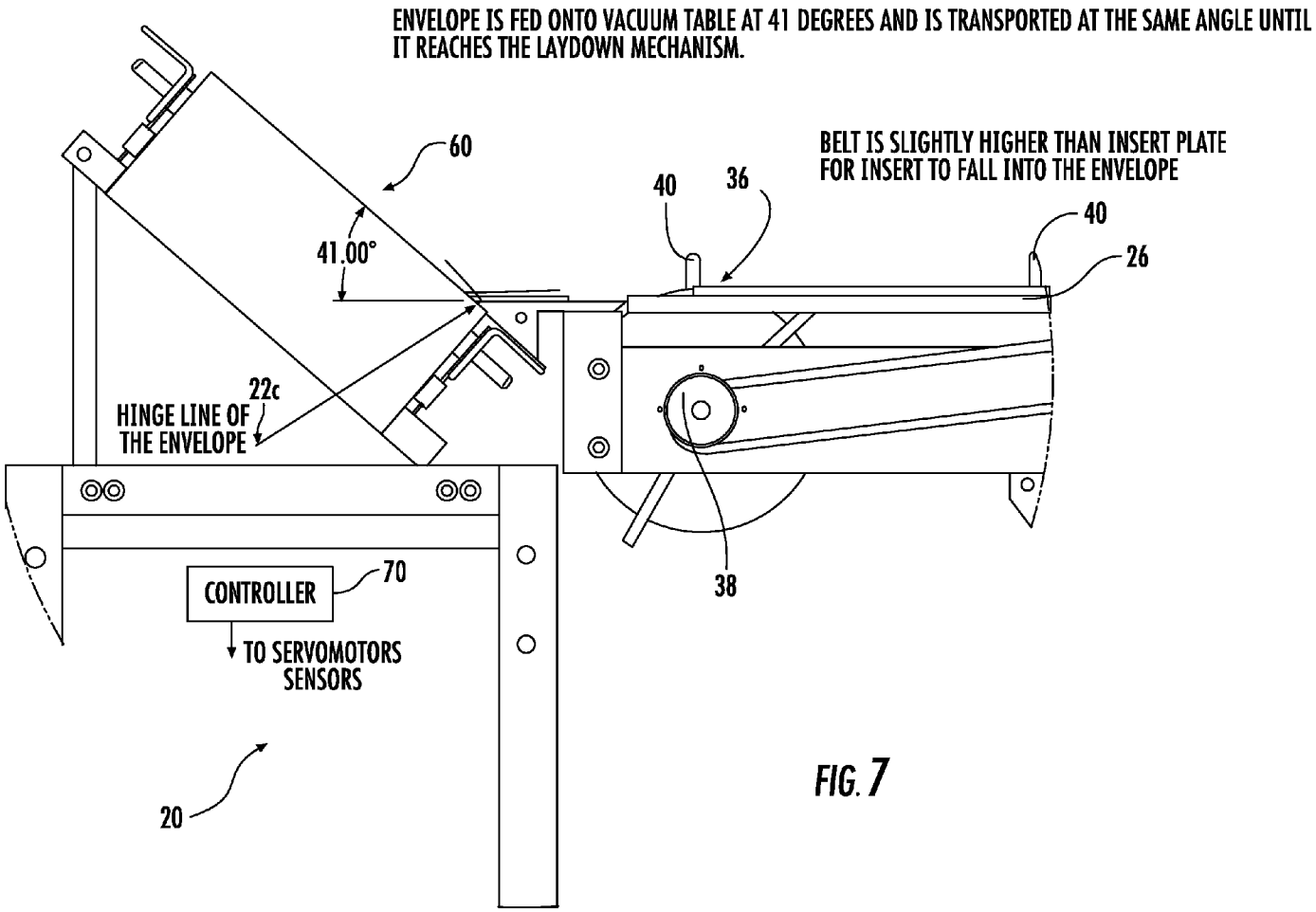
FIG. 7 is a fragmentary side elevation view of the document insertion machine showing the document conveyor formed as a belt conveyor and positioned slightly higher than the insert plate so that a leading edge of a document falls from the belt conveyor towards the envelope opening to be received therein and subsequently pushed therein by the pusher fingers.
Figure 9:
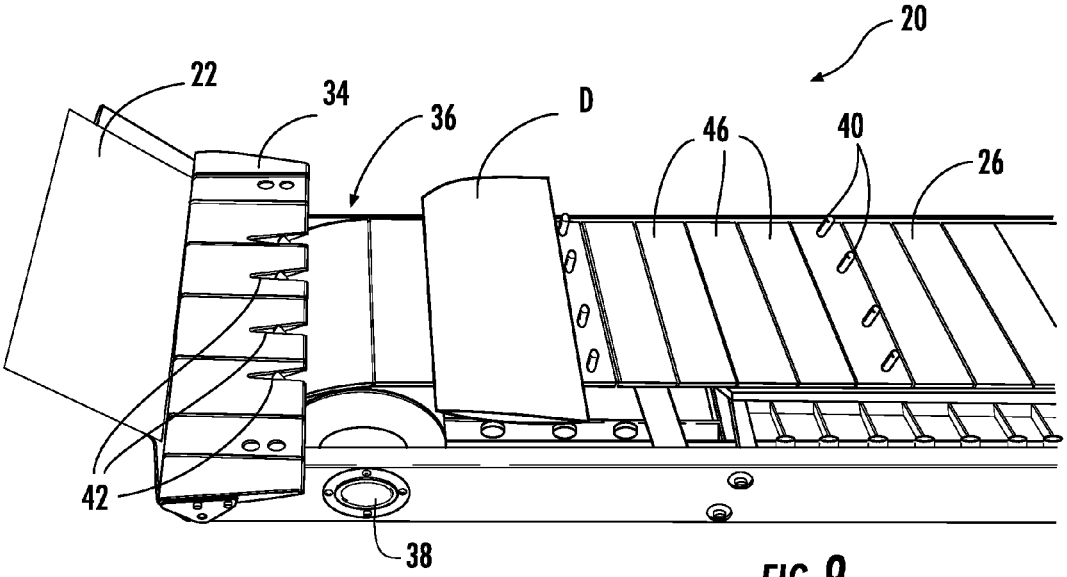
FIG. 9 is a fragmentary isometric view of the document conveyor and insert plate and showing a document being conveyed by the document conveyor into a position close to the insert plate.
Figure 10:
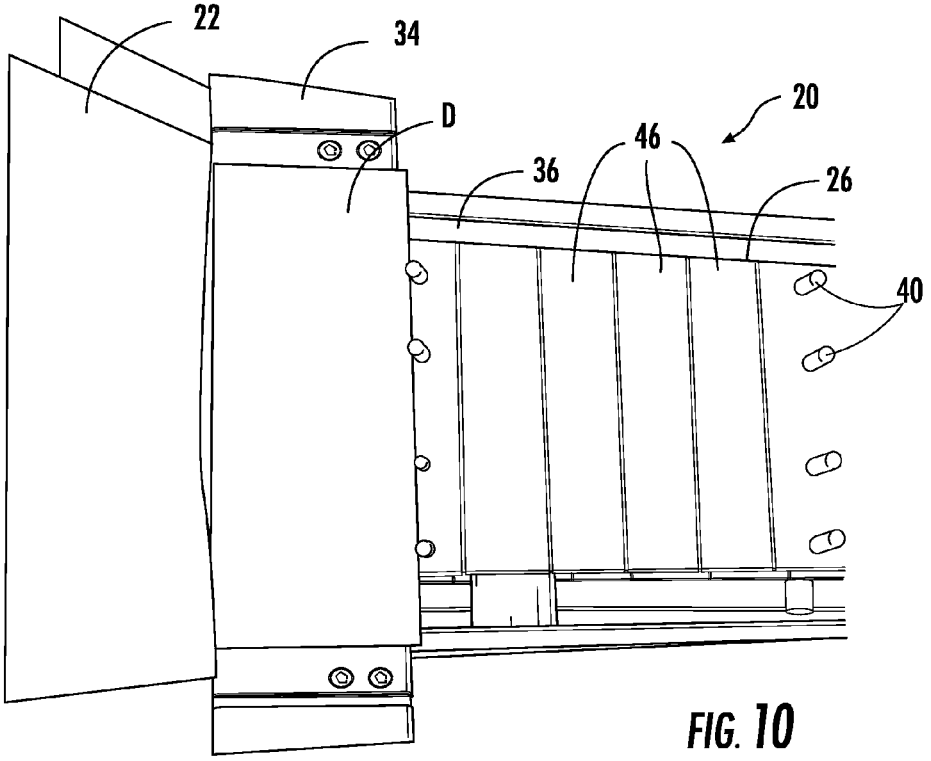
FIG. 10 is a partial isometric plan view of the document conveyor and showing the document initially falling into a position on the insert plate so that its leading edge enters the envelope and the pusher pins engage the document to insert the document initially into the envelope opening.
Figure 11:
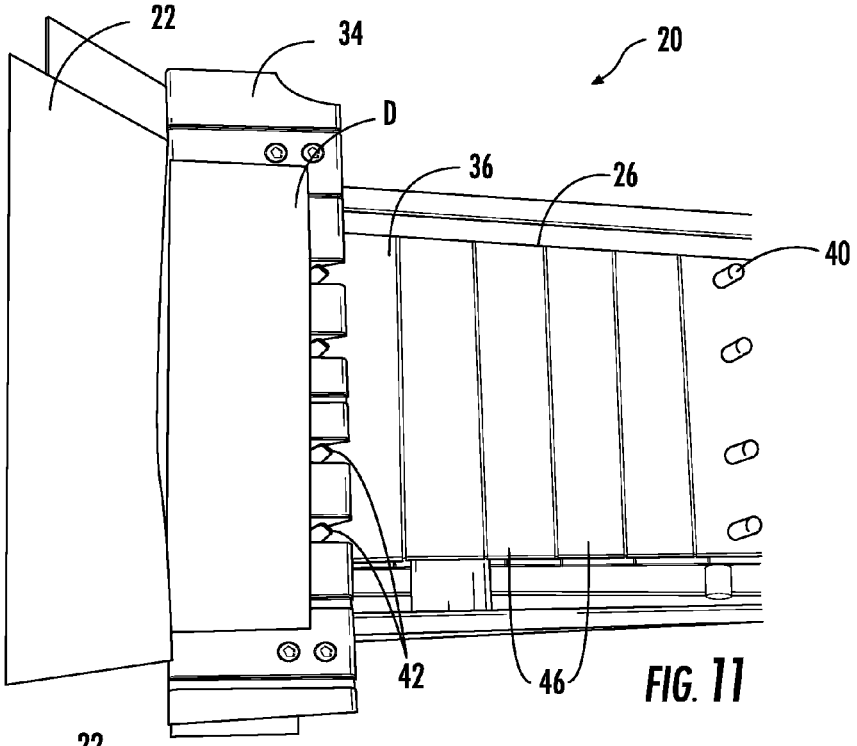
FIG. 11 is another view similar to that view shown in FIG. 10 and showing the pusher pins that have engaged and inserted the document partially into the envelope opening and been received within slots formed in the insert plate.

The document conveyor 26 in one example is formed as a belt conveyor having an end 36 positioned adjacent and above the insert plate 34, allowing documents conveyed along the document conveyor 26 to drop onto the insert plate 34 towards the envelope opening 22*a* as better shown in FIGS. 7, 9 and 10. FIGS. 1-5 show only the top portion of the document conveyor 26 for simplicity in the drawing, but it should be understood that the document conveyor 26 is formed as a loop typical of belt conveyors that continuously rotate on support sprockets 38 to advance documents on the document conveyor. As illustrated, the document conveyor includes pusher pins 40 that engage the document and insert the document (D) initially into the envelope opening 22*a* as shown in FIGS. 7 and 9-12. Slots 42 are formed in the insert plate 34 and receive the pusher pins 40 as the pusher pins traverse around the end of the document conveyor as best shown in FIG. 11.

Figure 8:
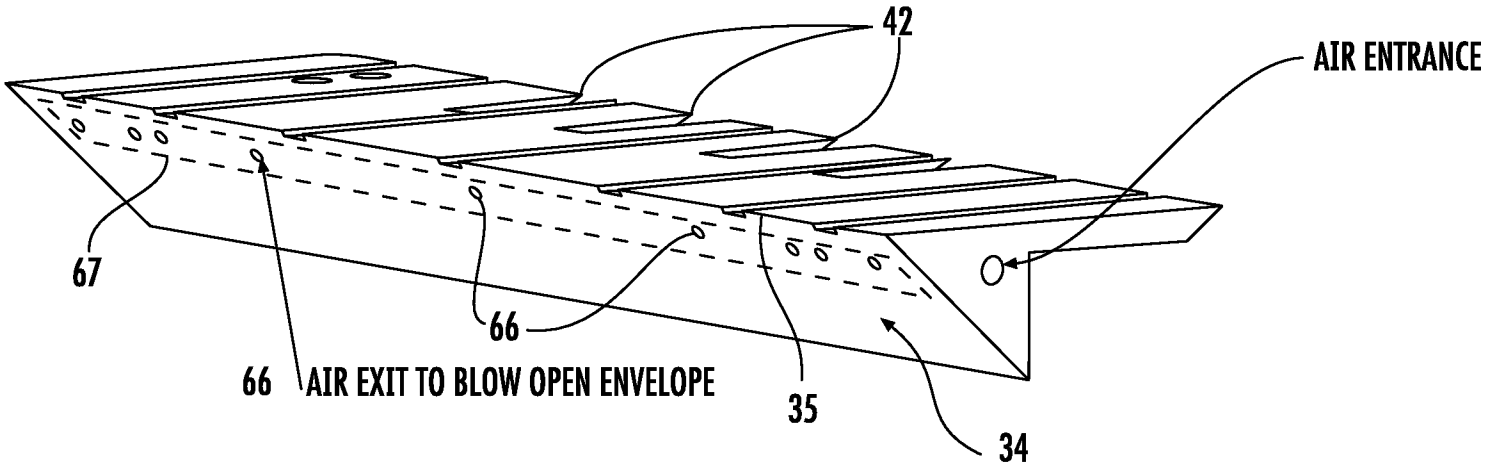
FIG. 8 is an enlarged isometric view of the insert plate showing the orifices through which air is blown to open an envelope.
Figure 8A:
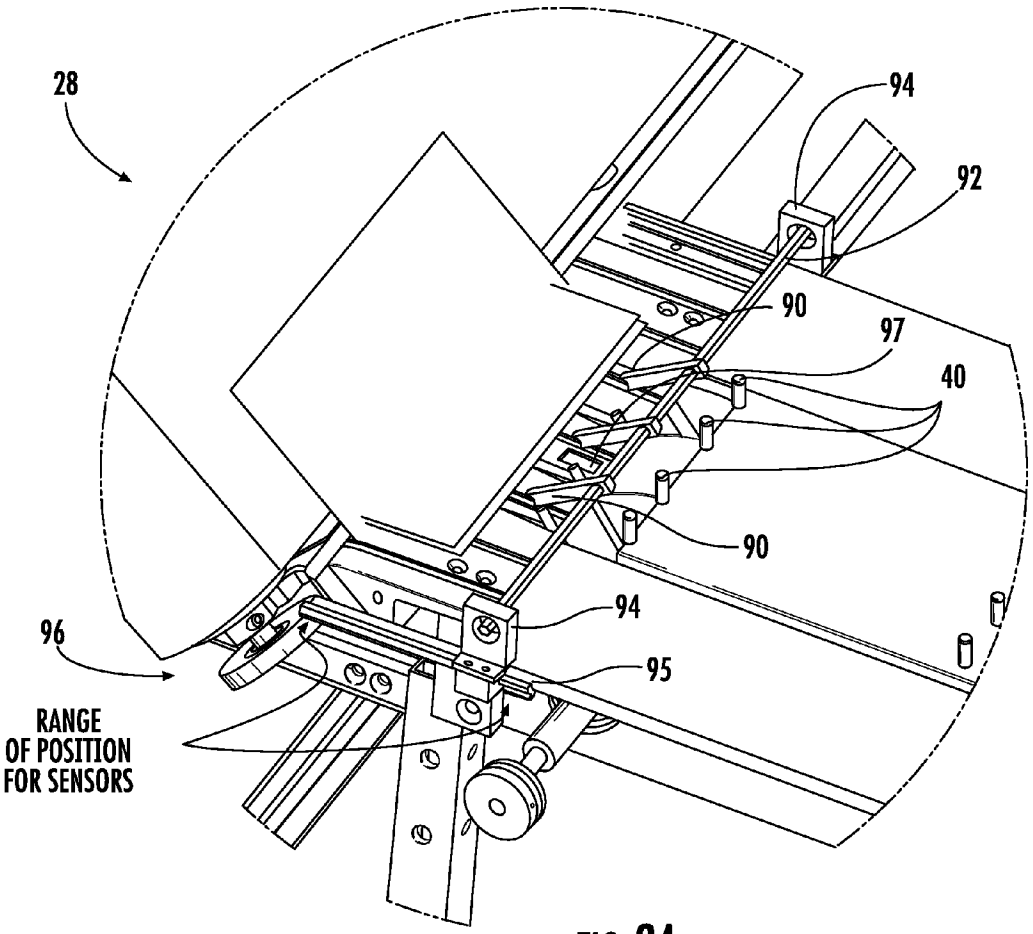
FIG. 8A is an enlarged isometric view of the document insertion machine showing a fragmentary view of the document conveyor and the pusher fingers located at the document insert station that receive the document from the pusher pins on the document conveyor and insert the document into the envelope.

Pusher fingers 90 receive the document from the pusher pins 40 and finish inserting the document into the envelope. As shown in FIG. 8A, three pusher fingers 90 are mounted adjacent the insert plate 34 on a transverse support rod 92 that extends over the insert plate. The support rod 92 is mounted on bearing supports 94 that are movable on a support rail 95. The pusher fingers may be moved into position as illustrated and the bearing supports 94 moved forward along the support rail 95 by an appropriate drive mechanism (not shown in detail) so that the pusher fingers 90 engage the document that has been initially inserted into the envelope opening and move the document forward so that the document is completely inserted into the envelope. The bearing supports will travel the last 3.5 inches in this particular example and receive the document as a hand-off from the pusher pins 40 on the conveyor belt. The bearing supports 94, support rail 95 and transverse support rod 92 with the pusher fingers 90, are shown in FIG. 8A and not shown in FIGS. 1-7 and 9-12.

Documents that are conveyed on the document conveyor 26 can be fed onto the document conveyor from one or more feed hoppers or storage bins or from a folding machine in which the documents are prepared and folded from sheets of paper or other flexible material. An example folding machine that could be used to supply the documents (D) into the document insertion machine 20 is described in the commonly assigned and incorporated by reference '972 patent application. An appropriate servomotor 44 operates as a drive mechanism and is connected to the document conveyor formed in this example as a belt conveyor to drive the conveyor forward and move documents into the document insertion station. The servomotor 44 may be connected to one or both of the support sprockets.

As best shown in FIGS. 9-12, the document conveyor 26 is formed as a belt conveyor with the belt formed from rectangular configured belt members or "slats" 46 that are connected or "linked" together to impart a somewhat rigid structural surface to the belt. Every few inches, which in the example shown in FIG. 9, is every five belt members or slats 46, the pusher pins 40 extend vertically upward from the belt member. In the illustrated example, for example, four (4) pusher pins 40 extend up from a respective belt member as a slat 46. As the conveyor belt traverses forward when it rotates around the support sprockets 38, the pusher pins 40 engage a document until the document drops onto the insert plate 34 towards the envelope opening 22*a* of an envelope 22 as shown in FIG. 10. As the belt continues advancing, the pusher pins 40 push the document (D) up and initially into the envelope opening 22*a* of the envelope that is angled at about 35 to 45 degrees from horizontal as illustrated (FIG. 7). As explained before, after the pusher pins 40 initially insert the document into the envelope opening 22*a*, the pusher fingers 90 positioned on the transverse support rod 92 and held by the bearing supports 94 are moved forward by moving the bearing supports 94 as the support rail 95. The pusher fingers 90 engage the document and push it into the envelope to complete insertion.

Figure 2:
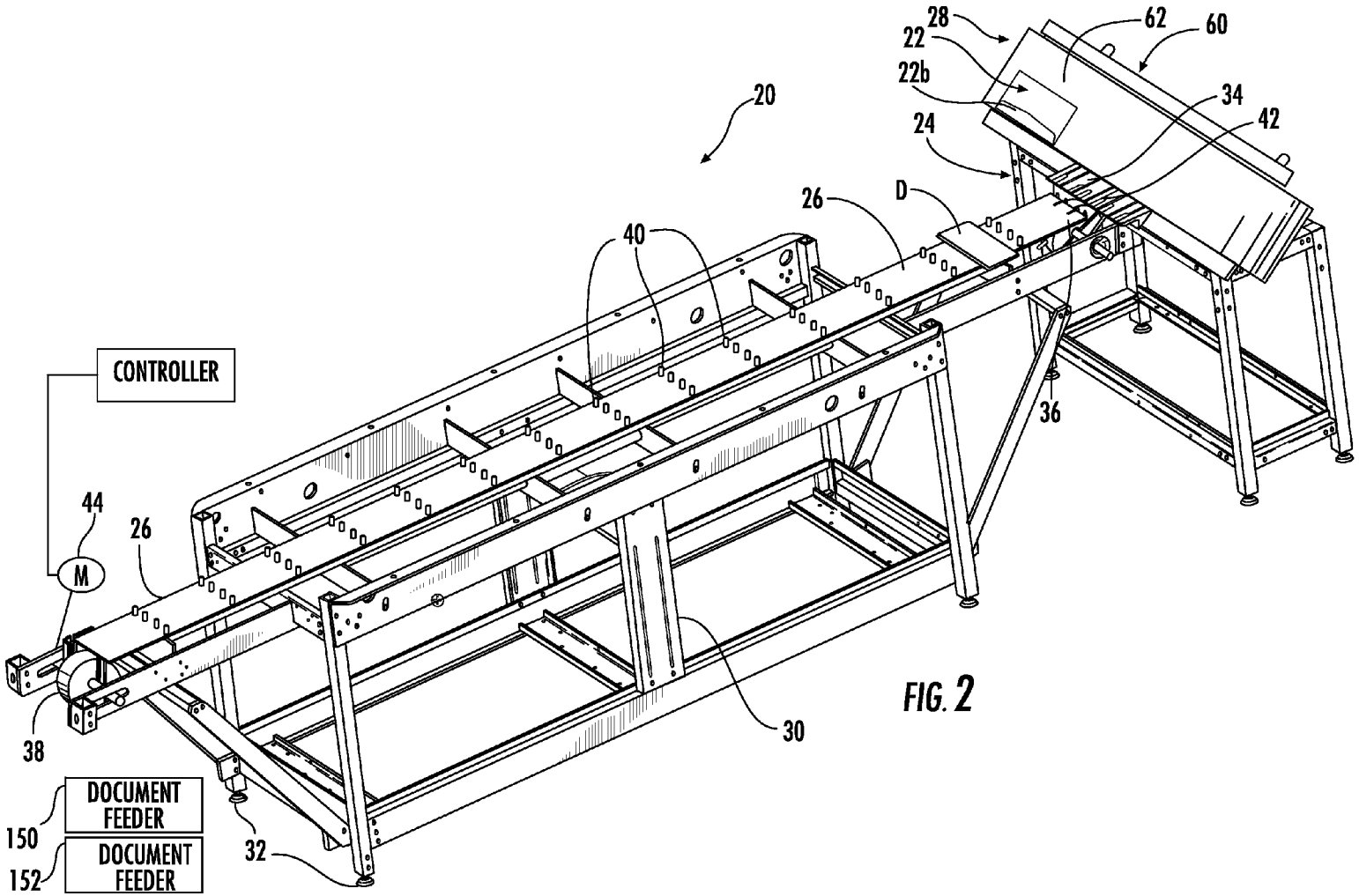
FIG. 2 is another isometric view of the document insertion machine showing an envelope fed upside down along its hinge line into the document insert station.

FIG. 1 shows a document (D) positioned on the document conveyor 26 and being conveyed into the document insert station 24. FIG. 2 shows an envelope 22 being fed by the envelope feeder 28 into the document insert station 24. FIG. 3 shows the envelope 22 of FIG. 2 as having advanced into the document insert station 24 and the document (D) shown in FIG. 2 having its leading edge inserted within the envelope opening 22*a* after the envelope has been blown open with compressed air or other gas such that the document is partially inserted within the envelope 22. Another envelope is positioned on the envelope feeder 28 as illustrated. The document (D) to be inserted into that second envelope is not shown on the document conveyor 26.

In the example as illustrated, the envelope feeder 28 feeds envelopes 22 on the hinge line and upside down into the document insert station 24. Each envelope has its flap 22*b* pointed up and each envelope oriented at an angle of about 35 to 45 degrees away from the document conveyor 26 and in the example shown in FIG. 7, at an angle of 41 degrees from the horizontal as illustrated. The envelope 22 is transported at the same angle until it reaches an envelope sealer 50 and then lay down mechanism 52 shown in FIGS. 4-6. An enlarged view of the insert plate 34 is shown at FIG. 8.

Figure 12:
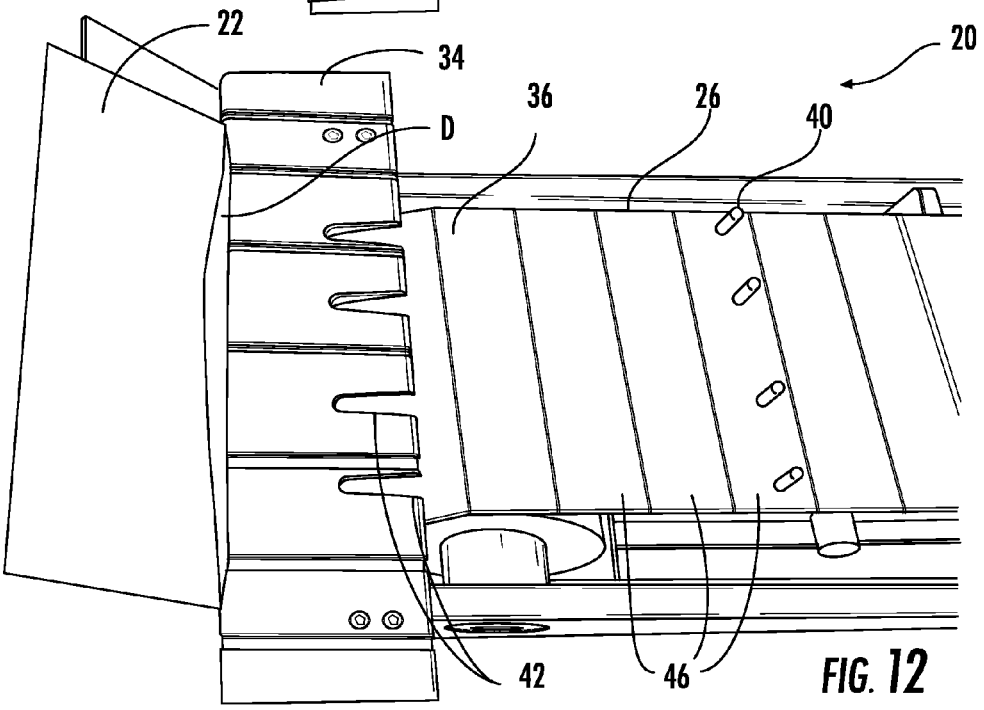
FIG. 12 is another fragmentary isometric view showing the document inserted within the envelope.

The insert plate 34 is positioned at the document insert station 24 and the flap 22*b*. The flap 22*b* is forced down such that the flap rides underneath the insert plate at its beveled edge 35 as shown in FIG. 8. The insert plate 34 has its slots 42 formed in the upper surface that receive the pusher pins 40 as they traverse around the end of the belt conveyor 26 as shown in FIGS. 11-12. A flap hold mechanism illustrated generally at 96 in FIG. 8A, will initially aid in pushing the flap down under the insert plate so that the insert plate will aid in retaining the flap open as the document is initially inserted. When a home edge sensor senses the edge of the envelope as it is fed towards the insert plate, the flap hold mechanism 96 will engage and the air is blown through the orifices so that the envelope is made ready for inserting, as explained below.

The envelope feeder 28 includes a vacuum feed table 60 that in one example includes a belt 62 driven by a servomotor 64 (FIG. 5) with vacuum drawn through the belt via belt orifices to allow vacuum suction to draw the envelope and retain the envelope on the belt. The vacuum feed table 60 is angled away from the document conveyor wherein the top of the envelope corresponding to the bottom of the envelope when oriented correctly is pivoted back as illustrated. The insert plate 34 is positioned and configured such that the insert plate will engage against the flap 22*b* and retain it open together with the flap hold mechanism relative to the envelope opening 22*a*. Air is discharged from the air orifices 66 within the insert plate 34 into the envelope opening to blow open the envelope to allow insertion of documents (FIG. 8). Air may be distributed using an internal air manifold 67 for the insert plate 66 as shown by the dashed lines. The insert plate 34 may be formed from unfinished aluminum in one example and is about 3.5 inches wide from the document conveyor end to the vacuum table.

Figure 5:
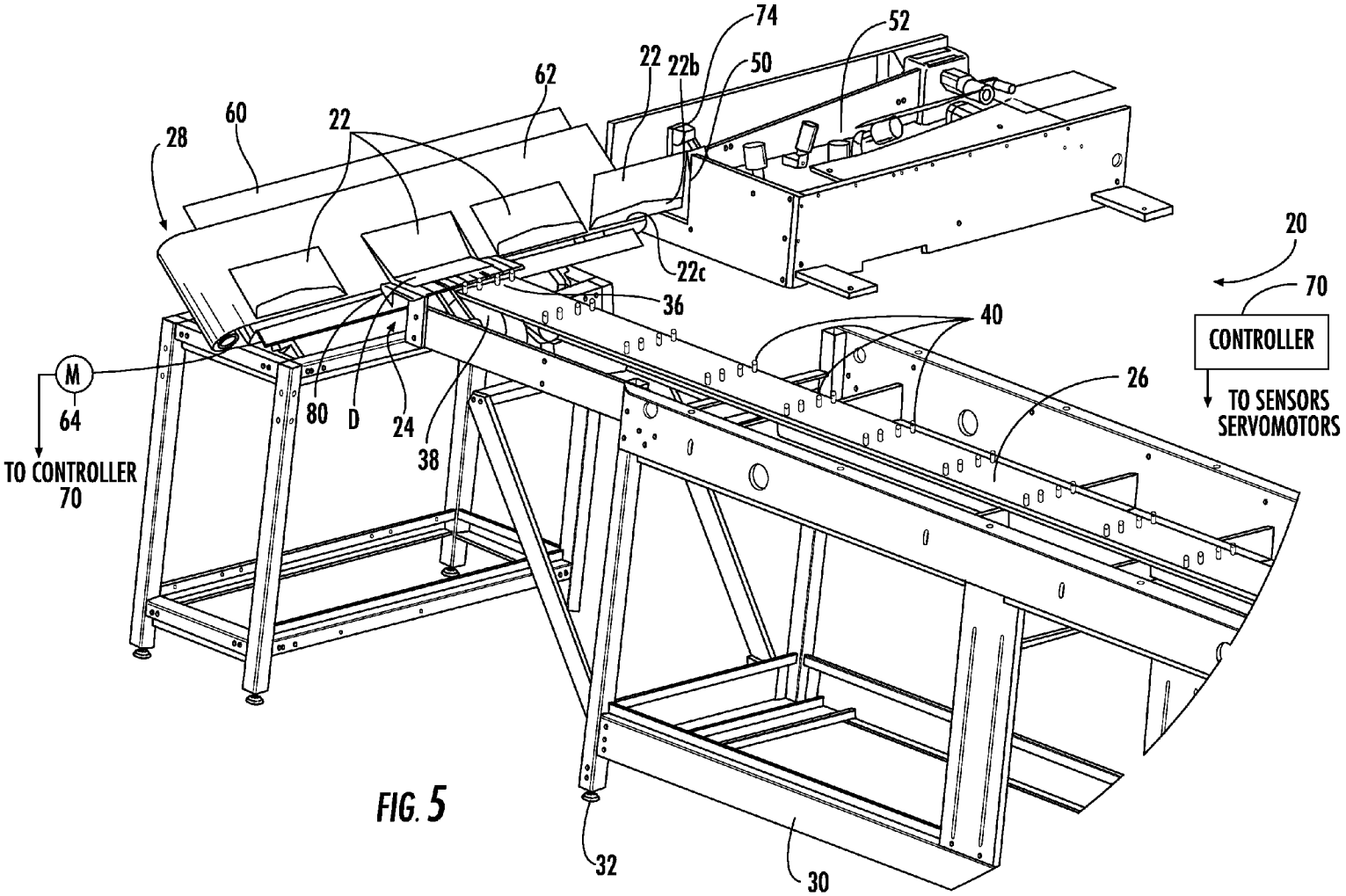
FIG. 5 is another isometric view of the document insertion machine from a different angle than that shown in FIG. 4 and showing the document conveyor, envelope feeder, envelope sealer, and envelope lay down mechanism.

In one example, the table 60 is configured such that each envelope is oriented at an angle of 35 to 45 degrees away from the document conveyor, and in one example, is 41 degrees as shown in FIG. 7. The servomotor 44 may drive the support or drive sprocket 38 of the document conveyor. The servomotor 64 may drive a drive sprocket 65 in the envelope feeder as shown in FIG. 5. Servomotors 44 and 64 may be controlled by an appropriate controller 70 as illustrated in FIGS. 1-5.

Figure 6:
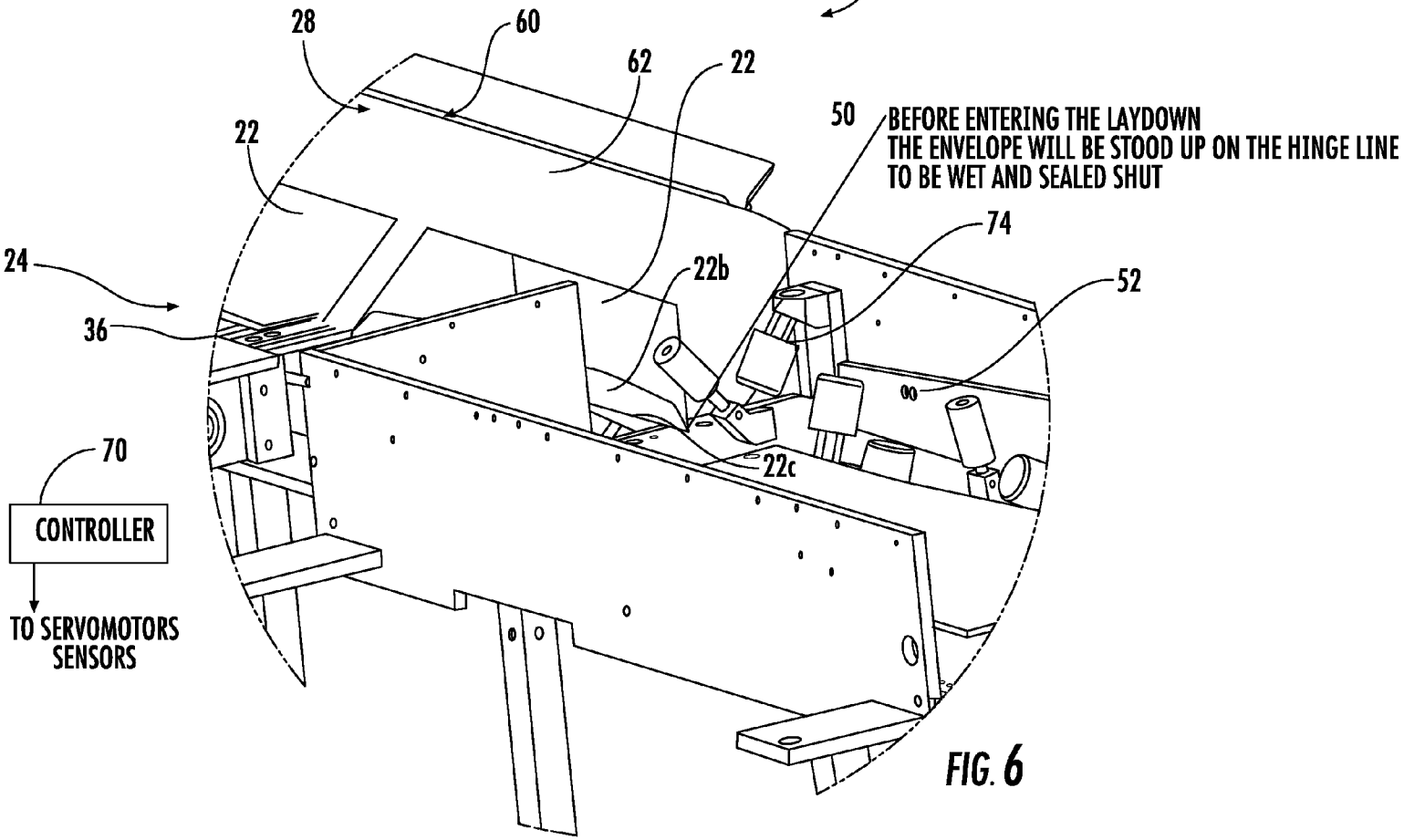
FIG. 6 is an enlarged isometric view of the document insertion machine at the end of the document conveyor, the envelope feeder, the envelope sealer, and envelope lay down mechanism.

FIGS. 5 and 6 show the envelope sealer 50 positioned after the document insert station 24 that seals the flap over the envelope opening 22*a*. The envelope 22 is oriented vertically by a roller or other orienting mechanism and stood up on its hinge line 22*c* as defined by the intersection of the main body of the envelope and the flap 22*b*. At this envelope sealer 50, the glue on the flap is wetted and the envelope sealed shut. The envelope is then fed into the lay down mechanism 52 where a roller assembly 74 at the lay down mechanism 52 moves the envelope into a flat or horizontal position where it can then be stacked into another feeder or fed into other mechanism or processing station, which is not illustrated in detail.

The document insertion machine 20 includes different sensors that can be formed as photocells in certain examples. The general location of an envelope home edge sensor 80 is illustrated in FIG. 5. FIG. 8A shows a paper sensor slot 97 in the insert plate that contains various sensors to enable the pusher fingers 90 to move or push the document completely into the envelope. Different types of sensors and photocells may be used and the following description and flowchart relative to FIG. 13 describes the basic sensors. The location of the sensors can vary depending on the specific dimensions and design but the description will give a good representation of the types of sensors that can be used. There now follows a description of the operation of the various servomotors relative to the sensors and photocells to understand the various functions relative to the envelope and document flow.

Figure 13:
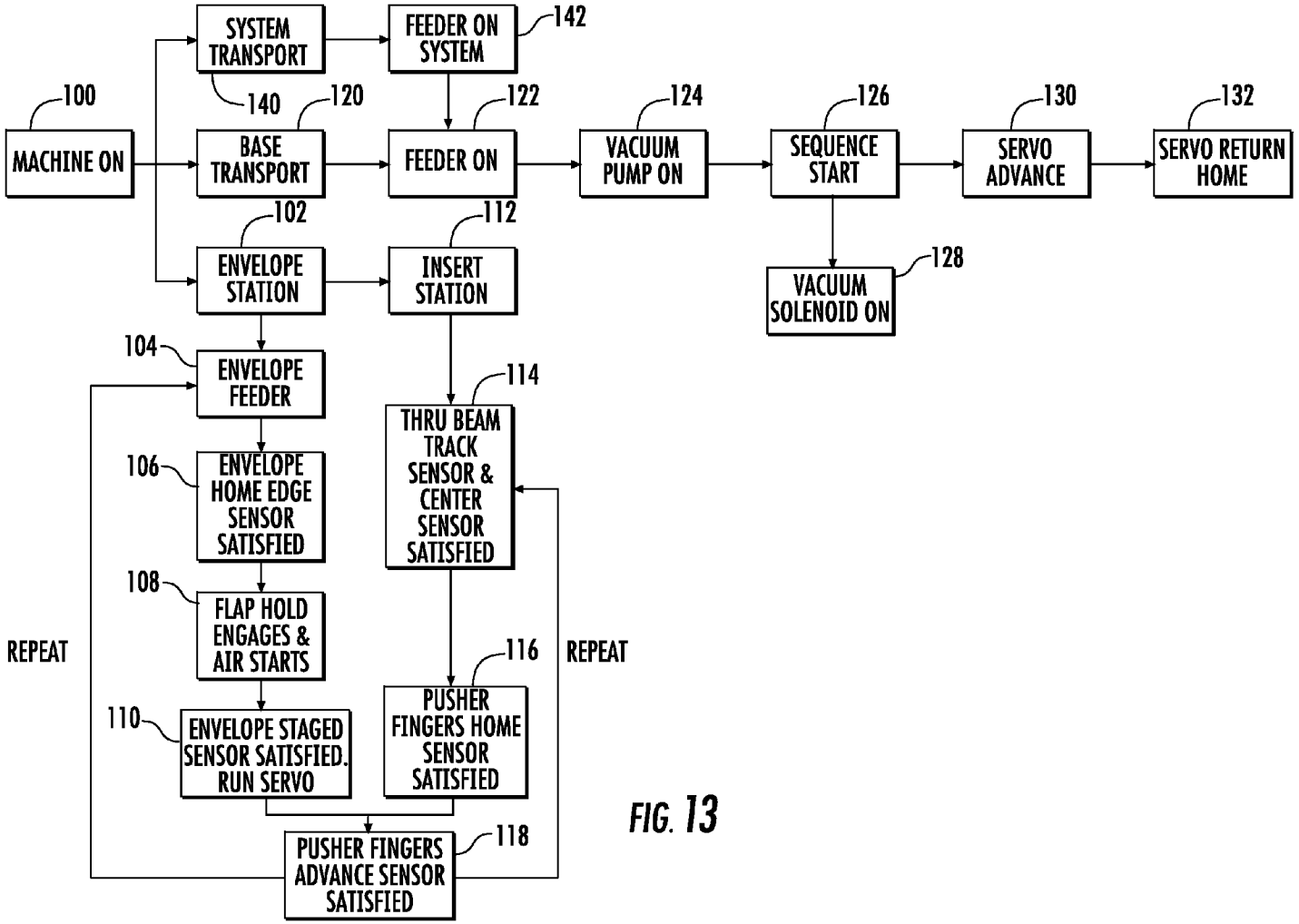
FIG. 13 is a flowchart showing basic modules in an algorithm for the product flow corresponding to the feeding of envelopes and documents as inserts that are inserted within an envelope.

FIG. 13 is flowchart illustrating the basic modules and algorithm for the product flow corresponding to the feeding of envelopes along the envelope feeder and documents as inserts that are inserted within an envelope. For purposes of description, the term "documents" signifies the different papers as inserts that will be inserted within an envelope, including one or more sheets of paper such as page sets.

The process begins with the Machine On function (Block 100) that starts the document conveyor formed as a belt conveyor in this example cycling at 20,000 documents as inserts per hour and allowing for the standard operations and document insertions to be performed. In one example, 20,000 two-page sets formed as the documents or inserts may be processed per hour. The Envelope Station function (Block 102) is on or operable when the Machine On mode is functioning and initiates the servomotor 64 for the envelope feeder (Block 104). When the Envelope Home Edge Sensor 80 is satisfied (Block 106), such as when the edge of the envelope has been sensed by that sensor, the envelope feeder and the document conveyor as the belt conveyor in this example will cycle until the envelope is made ready for document insertion at the document insert station.

When that Envelope Home Edge Sensor 80 is satisfied, the envelope is also made ready for inserting as the flap is opened and pulled down so that the flap is under the insert plate and air is blown from the manifold through the orifices and into the envelope opening to open the envelope (Block 108). When an envelope staged (or support) sensor such as positioned on the vacuum feed table is satisfied (Block 110), the envelope feeder servomotor is initiated and the envelope feeder will feed envelopes until both the envelope staged (or support) sensor and the envelope insert station function are satisfied.

The Insert Station function is on to allow documents to be inserted when the Machine On mode is in process (Block 112). When a thru beam sensor and center sensor that are positioned are satisfied (Block 114), this will complete a first step in a three-step process and allow the pusher fingers to move the document as an insert into the envelope after it has been initially inserted into the envelope opening. When the center sensor is satisfied (also Block 114) indicative that a medial position has been reached, this is the second step in the three-step process that will allow the pusher fingers to move the document as an insert into the envelope. When a pusher finger home sensor is satisfied (Block 116), this is the third step in the three-step process that will allow the conveyor pins as pusher fingers to move the document as an insert into the envelope. A pusher finger advance sensor is satisfied when the product is inserted into the envelope (Block 118) and the pusher fingers have been moved into the slots of the insert plate 34. This entire process repeats after this function is satisfied for both the envelope feeder and document conveyor to allow continued insertion of documents into envelopes.

The sensor(s) in the document sensor slot 97 will indicate when a document has extended initially onto the insert plate such as assisted by the pusher pins. Although the sensors may be located at different positions on the document insert machine, the different sensors, such as the through beam sensor and center sensor together with the pusher finger home sensor and pusher finger advance sensor, may be located along the side generally as described in FIG. 8A such that when the bearing support traverses forward, the sensors will know the location relative to the pusher fingers and the stage at which the document has been inserted into the envelope.

There are two modes that will allow documents, e.g., two-page sets as inserts to be pulled from designated document feeders that an operator initiates. These documents may have been loaded into the feeder from a folding machine such as described in the incorporated by reference '972 patent application or stored in the document feeder. Document feeders are shown schematically at 150 and 152 in FIGS. 1-3. These two modes are the base transport mode (Block 120) and the system transport mode (Block 140). The base transport mode will allow the document feeders 150, 152 to feed documents as inserts on the document conveyor using software to control a sequential start-up and shut down. A Feeder On function (Block 122) allows an operator to choose which document feeders 150, 152 will run into the document conveyor and the order in which the documents will be inserted into an envelope at the document insert station. For example, different document feeders may contain different documents such as multiple page sets or other types of documents and the operator will choose which document feeder will feed documents into the document conveyor 26.

A vacuum pump on function (Block 124) occurs when an operator selects a certain document feeder to supply documents for insertion. A vacuum pump is turned on and supplies the necessary vacuum for one or more documents to be separated to ready a document as an insert. The sequence starts (Block 126) as an operator function. The operator determines when the sequence will start by using embedded software. A vacuum solenoid on function (Block 128) occurs when an operator initiates a sequence start (Block 126) and separates the document as an insert so that the servomotor controlling the document conveyor will advance the document from the feeder to the conveyor. The servo advance function (Block 130) will initiate the servomotor to advance, using a control signal from the embedded software and follow the sequence the operator has set relative to the document insert station. The server returns a home function (Block 132) and sets the document insert station to repeat the process when the embedded software sends the signal.

The system transport mode (Block 140) is a mode where the operator selects when the document conveyor and document insert station are controlled by printed information on a document. The software will transfer the information to the base machine to control what documents will be formed as inserts to be assembled with information derived from a control document. The feeder on system (Block 142) is a function that allows the operator to select which document feeders will be on for the system mode. The embedded software will prevent a document feeder from feeding if it is not required for that control document.

It should be understood that the documents as inserts that are conveyed into the envelopes can be folded and prepared using a folding machine that is combined knife and buckle folders as disclosed in U.S. patent application Ser. No. 13/972,972. In that folding machine, an accumulator will accumulate at least one sheet of flexible substrate material such as page sets and a knife folder adjacent the accumulator has a knife fold plate that receives the at least one sheet and a knife blade that reciprocates against the at least one sheet. Buckle fold drive rollers are adjacent the knife folder and receive the at least one sheet driven from the knife blade to form a knife fold. At least one buckle folder is oriented along the buckle fold drive rollers and receives the knife fold to form a buckle fold in the at least one sheet. One or two collectors may be used in that folding machine and a single set or a completed subset may be dumped into a track of the inserting machine at zero degrees or dumped onto a conveyor and the process repeated.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for inserting documents into envelopes, comprising:

a document insert station;

a document conveyor that conveys documents horizontally to be inserted within envelopes to the document insert station, each envelope having an envelope opening and a flap to close the opening and defining a hinge line at the intersection of the flap and envelope opening;

an envelope feeder that feeds envelopes upside down with the hinge line facing downward and into the document insert station and at an angle away from the document conveyor and on the hinge line with the flap oriented upward from the hinge line away from the document conveyor; and an insert plate having a beveled edge and positioned at the document insert station that receives a document conveyed from the document conveyor and having orifices though which air is blown onto the envelope to open the envelope, wherein the insert plate is configured to engage the flap of the envelope at the beveled edge of the insert plate and force the flap to extend under the insert plate at its beveled edge and retain the flap open, and wherein air is blown through the orifices to open the envelope.

2. The apparatus according to claim 1, wherein the envelope feeder comprises a vacuum feed table that is angled to orient each envelope away from the document conveyor.

3. The apparatus according to claim 1, wherein the insert plate includes an air manifold connecting to the air orifices through which air is blown.

4. The apparatus according to claim 1, wherein the document conveyor is positioned above the insert plate allowing documents conveyed along the document conveyor to drop onto the insert plate and towards the envelope opening of an envelope fed into the document insert station.

5. The apparatus according to claim 1, wherein the document conveyor includes pusher pins that engage the document and push it into the envelope opening.

6. The apparatus according to claim 5, wherein the document conveyor comprises a belt conveyor having an end positioned adjacent the insert plate and said insert plate includes slots that receive the pusher pins as the pusher pins traverse around the end of the belt conveyor adjacent the insert plate.

7. The apparatus according to claim 5, and further comprising pusher fingers mounted adjacent the insert plate that receive the document from the pusher pins to insert the document into the envelope once the document has been received in the envelope opening.

8. The apparatus according to claim 1, and further comprising an envelope sealer positioned after the document insert station that seals the flap over the envelope opening.

9. The apparatus according to claim 8, and further comprising a lay down mechanism positioned after the envelope sealer and configured to lay down the envelope into a horizontal position.

10. The apparatus according to claim 1, wherein the documents each comprise one or more sheets of paper.

11. An apparatus for inserting documents into envelopes, comprising:

a document insert station;

a document conveyor that conveys documents horizontally to be inserted within envelopes to the document insert station, each envelope having an envelope opening and a flap to close the opening and defining a hinge line at the intersection of the flap and envelope opening;

an envelope feeder that feeds envelopes upside down with the hinge line facing downward and into the document insert station and at an angle away from the document conveyor and on the hinge line with the flap oriented upward from the hinge line away from the document conveyor;

an insert plate having a beveled edge and positioned at the document insert station that receives a document conveyed from the document conveyor and having orifices though which air is blown onto the envelope to open the envelope, wherein the insert plate is configured to engage the flap of the envelope at the beveled edge of the insert plate and force the flap to extend under the insert plate at its beveled edge and retain the flap open, and wherein air is blown through the orifices to open the envelope;

an envelope sealer positioned after the document insert station that seals the flap over the envelope opening; and a lay down mechanism positioned after the envelope sealer and configured to lay down the envelope into a horizontal position.

12. The apparatus according to claim 11, wherein the envelope feeder comprises a vacuum feed table that is angled to orient each envelope away from the document conveyor.

13. The apparatus according to claim 11, wherein the insert plate includes an air manifold connecting to the air orifices through which air is blown.

14. The apparatus according to claim 11, wherein the document conveyor is positioned above the insert plate allowing documents conveyed along the document conveyor to drop onto the insert plate and towards the envelope opening of an envelope fed into the document insert station.

15. The apparatus according to claim 14, and further comprising pusher fingers mounted adjacent the insert plate that receive the document from the pusher pins to insert the document into the envelope once the document has been received in the envelope opening.

16. The apparatus according to claim 11, wherein the document conveyor includes pusher pins that engage the document and push it into the envelope opening.

17. The apparatus according to claim 16, wherein the document conveyor comprises a belt conveyor having an end positioned adjacent the insert plate and said insert plate includes slots that receive the pusher pins as the pusher pins traverse around the end of the belt conveyor adjacent the insert plate.

18. The apparatus according to claim 11, wherein the documents each comprise one or more sheets of paper.

* * * * *